US007073593B2

(12) United States Patent
Hatton et al.

(10) Patent No.: US 7,073,593 B2
(45) Date of Patent: Jul. 11, 2006

(54) METHOD OF DRILLING AND OPERATING A SUBSEA WELL

(75) Inventors: Stephen A. Hatton, Woking (GB); Frank Lim, Bucks (GB); Hugh Howells, Surrey (GB)

(73) Assignee: 2H Offshore Engineering LTD, Woking (GB)

( * ) Notice: Subject to any disclaimer, the term of this patent is extended or adjusted under 35 U.S.C. 154(b) by 45 days.

(21) Appl. No.: 10/466,131

(22) PCT Filed: Jan. 9, 2002

(86) PCT No.: PCT/GB02/00066

§ 371 (c)(1),
(2), (4) Date: Jul. 9, 2003

(87) PCT Pub. No.: WO02/055836

PCT Pub. Date: Jul. 18, 2002

(65) Prior Publication Data

US 2004/0074649 A1 Apr. 22, 2004

(30) Foreign Application Priority Data

Jan. 10, 2001 (GB) ..... 0100565.1

(51) Int. Cl.
*E21B 29/12* (2006.01)

(52) U.S. Cl. ..... 166/367; 166/345; 166/359; 405/224.4

(58) Field of Classification Search ..... 166/368, 166/367, 344, 345, 359, 358, 350; 405/224.4, 405/224
See application file for complete search history.

(56) References Cited

U.S. PATENT DOCUMENTS

| | | | | |
|---|---|---|---|---|
| 3,179,179 | A | 4/1965 | Kofahl | |
| 3,225,826 | A | 12/1965 | Postelwaite | |
| 3,653,435 | A * | 4/1972 | Reistle et al. | 166/366 |
| 4,023,619 | A * | 5/1977 | Marquaire et al. | 166/341 |
| 4,211,281 | A * | 7/1980 | Lawson | 166/345 |
| 4,317,488 | A * | 3/1982 | Shotbolt | 166/351 |
| 4,378,848 | A * | 4/1983 | Milberger | 166/351 |
| 4,622,806 | A * | 11/1986 | Bahnman et al. | 56/16.2 |
| 4,793,737 | A * | 12/1988 | Shotbolt | 405/169 |
| 5,159,982 | A | 11/1992 | Hynes | |
| 5,330,293 | A * | 7/1994 | White et al. | 405/211 |
| 5,342,148 | A | 8/1994 | Huete et al. | |
| 5,439,060 | A * | 8/1995 | Huete et al. | 166/367 |
| 5,533,574 | A | 7/1996 | Gonzalez | |
| 5,615,977 | A * | 4/1997 | Moses et al. | 405/195.1 |
| 5,706,897 | A * | 1/1998 | Horton, III | 166/359 |
| 5,873,416 | A * | 2/1999 | Horton, III | 166/344 |

(Continued)

FOREIGN PATENT DOCUMENTS

| | | |
|---|---|---|
| DE | 1205924 | 12/1965 |
| EP | 0709545 | 5/1996 |
| WO | WO98/23846 | 6/1998 |

*Primary Examiner*—Thomas A Beach
(74) *Attorney, Agent, or Firm*—O'Keefe, Egan & Peterman, LLP

(57) ABSTRACT

A method of preparing and operating a subsea well (23), comprising the steps of: locating a drill-through subsea tree (24) on a subsea wellhead; sealingly connecting a high pressure drilling riser (22) between the tree and a drilling platform at the sea surface; mounting a blow out preventer (16) at the top of the riser (22); drilling the well through the drilling riser and the subsea tree; and establishing a production connection between the tree (24) and a production collection facility at the sea surface through a production riser (52) which is separate from the drilling riser (22).

18 Claims, 6 Drawing Sheets

U.S. PATENT DOCUMENTS 5,881,815 A * 3/1999 Horton, III ..... 166/350
5,992,527 A * 11/1999 Garnham et al. ..... 166/379
6,039,119 A * 3/2000 Hopper et al. ..... 166/368
6,213,215 B1 * 4/2001 Breivik et al. ..... 166/350
6,227,300 B1 * 5/2001 Cunningham et al. ..... 166/339
6,293,345 B1 * 9/2001 Watkins ..... 166/368
6,321,844 B1 * 11/2001 Thiebaud et al. ..... 166/345
6,336,421 B1 * 1/2002 Fitzgerald et al. ..... 114/264
6,497,286 B1 * 12/2002 Hopper ..... 166/368
6,640,902 B1 * 11/2003 Baten et al. ..... 166/368
6,672,390 B1 * 1/2004 Azancot ..... 166/341
6,805,200 B1 * 10/2004 DeBerry ..... 166/347

* cited by examiner

METHOD OF DRILLING AND OPERATING A SUBSEA WELL

This invention relates to a method of preparing and operating a subsea well, and to subsea well components for use in such a method. The invention is particularly intended for use in floating drilling and production system used in the recovery of offshore oil and gas reserves in deep water environments. 'Deep water' environments are usually considered as those where the operating depth is 800 metres or more.

A number of deep water reservoirs have been or are proposed to be developed using floating vessels with vertically tensioned high pressure drilling and production risers. This approach allows both the drilling BOP (blow out preventer) and production tree to be located on the vessel (often referred to as a 'dry tree' arrangement) providing access to the BOP and production tree reducing the duration of drilling and workover operations and cost. In this arrangement particular attention must be paid to well control requirements since in the event of a riser failure the well can be left in an unstable condition, resulting in an uncontrolled blow-out situation. To achieve acceptable reliability dual casing risers are utilised to provide redundant pressure barriers. However, as the search for hydrocarbons extends to even greater water depths the complexity of these high pressure dual casing risers and particularly their suspended weight becomes a significant cost driver.

According to the invention, there is provided a method of preparing and operating a subsea well, the method comprising the steps of

- locating a drill-through subsea tree on a subsea wellhead
- sealingly connecting a high pressure drilling riser between the tree and a drilling platform at the sea surface
- mounting a blow out preventer at the top of the riser
- drilling the well through the drilling riser and the subsea tree; and
- establishing a production connection between the tree and a production collection facility at the sea surface through a production riser which is separate from the drilling riser.

Use of this method offers the ability to efficiently drill, produce and workover subsea wells in deep water by combining manifolded drill-through spool trees, a high pressure drilling riser with surface BOP and free standing offset production risers.

This can simplify the riser design, reduce the number of risers required and simplify the interface with a vessel or platform with the objective of reducing cost and improving safety.

In the invention, production risers can be run through the moonpool of a moored drilling vessel and a smaller vessel can be used to do the final installation onto the riser foundation.

The pressure retaining drilling riser may comprise two concentric riser pipes, the inner of the pipes being a high pressure riser and the outer of the pipes being a low pressure riser. The low pressure riser can then be first connected between the tree and the drilling platform with a low pressure blow out preventer mounted at the top of the riser. The well can then be drilled to a first depth, the low pressure blow out preventer removed and the high pressure riser run into the low pressure riser. A high pressure blow out preventer is then mounted at the top of the high pressure riser, and the well is drilled to a second, greater depth.

A plurality of wells can be drilled adjacent to one another, and the production outflows from adjacent wells can be comingled in a manifold at the seabed before being introduced to the production connection to the sea surface.

The drilling platform and the production collection facility can be provided on separate platforms/vessels at the sea surface.

The invention also provides a drill-through subsea tree adapted for use in the method set forth above. In particular, the tree may have an outlet for connection to a production pipe, and means for providing a direct sealing connection to a pressure retaining riser so that drilling can take place through the riser and through the subsea tree.

The invention includes a permanently moored floating drilling and production system for deep water comprising: a) manifolded drill through subsea trees located (directly) below the floating vessel; b) a high pressure drilling workover riser and c) a surface BOP configured with the objective of reducing riser numbers and tension requirement and maintaining vertical wellbore access.

The invention also includes a riser system for use in drilling and producing a deepwater well from a permanently moored floating vessel comprising: a high pressure vertically tensioned marine riser system with surface BOP for drilling operations extending downwardly from the surface vessel and connected and sealed to a drill through subsea tree that is attached to a subsea wellhead located substantially below the surface vessel.

The invention also includes a riser system for use in drilling and producing a deepwater well from a permanently moored floating vessel comprising dual string concentric pipe arrangement comprising: 1) an outer riser extending from the surface vessel connected and sealed to a drill through subsea tree that is connected onto a subsea well for drilling an initial low pressure interval; 2) a retrievable inner riser extending from the surface downwardly to the subsea tree inside the outer riser and connected and sealed on the bore of the subsea tree or wellhead.

The inner string can be a casing.

On completion of a well, the riser system can be disconnected from the drill through subsea tree, lifted slightly and moved across onto and connected and sealed to another drill through subsea tree for drilling or intervention.

The invention also extends to a floating drilling and production vessel with multiple drill through subsea trees located below the vessel with drilling and workover conducted vertically using high pressure risers with surface BOP.

This surface vessel can use free standing production risers to transfer commingled fluids from drill through subsea trees to the drilling and production vessel.

Free standing offset risers can be used to transfer commingled fluids from subsea trees to an adjacent storage.

The offset risers can be initially connected to the drilling/production facility for early production and subsequently disconnected and reconnected to an adjacent storage facility. The risers can be installed through the moonpool or over the side of a permanently moored drilling and production vessel.

The production risers can be assembled using threaded connections.

The invention also extends to the installation of manifold structures through the moonpool of a moored drilling and production vessel where the manifold is initially run in a vertical orientation in order to pass the moonpool and subsequently rotated horizontally after landing on the seabed or in midwater.

Still further, the invention extends to the installation of near neutrally buoyant rigid flowline spools to which the manifold has been assembled using threaded connections and initially run in the vertical orientation and subsequently rolled over to the horizontal orientation after passing through the moonpool of the vessel.

Yet another feature of the invention is the use of a radial orientation key in the bore of a high pressure drilling riser to locate and align a tubing hanger landed in the bore of a drill through spool tree In the event that a single string drilling riser is utilised a shear ram module may be used at the base of the riser to isolate the well in the event of a riser failure. The shear ram module will connect to the subsea tree mandrel via a remote connector and will have at its top end a mandrel onto which the drilling riser is connected. In the unlikely event that the shear ram is actuated to close in the well, the drilling riser is then retrieved and repaired prior to reinstallation on the shut-in well.

The invention thus relates to an offshore production system for deep and ultra deep water developments that allows drilling, production and workover of subsea wells.

There are four main elements used in the production system, ie

Moored floating production unit

Drill through subsea trees with compact manifold

High pressure drilling riser

Free standing offset production risers

The floating production unit may take a number of different forms including barge, ship, semi-submersible, TLP (tension leg platform) or Spar. However, in its simplest form it consists of a flat bottom barge constructed from either steel or concrete. The barge provides drilling, production, storage and accommodation facilities with the drilling facilities being located near the centre of the vessel where vessel motions are smallest. A drilling derrick is located directly above a central moonpool that facilitates installation of a high pressure drilling riser.

A vertically tensioned high pressure drilling riser is proposed, similar to that used on existing deepwater developments. The riser pipe is constructed from steel tubulars, connected by flanged couplings. The riser is rated to the maximum reservoir pressure and a surface BOP is used to control the flow of drilling fluids and returns in and out of the well bore. The drilling riser may be either a single string or a dual string concentric arrangement. If a single string riser is used a riser base shear ram module may also be used immediately above the tree. The BOP is located in the moonpool directly below the derrick.

During drilling operations control of the subsea tree and riser base shear ram module is provided via a control umbilical run on the outside diameter of the drilling riser. Following connection of the drilling riser to the tree control of the tree functions is provided and the production control is isolated.

Subsea trees and manifolds are located on the seabed below the production vessel. The trees are 'spool' or 'drill through' design allowing full bore access to the well onto which they are connected. The trees can be installed on to the subsea wellhead on the bottom end of the drilling riser with subsequent drilling activities conducted directly through the tree.

Well intervention and light workover operations can be completed through a small bore high pressure riser typically 8⅝ inch diameter. The single string riser is run down and attached to the upper mandrel of the tree in the same way as the drilling riser. A similar surface BOP, but of smaller internal diameter is used at the surface. Such a lightweight riser system allows access into the production tubing. For additional safety an isolation valve may be included at the base of the riser capable of shearing wireline, slickline and coiled tube.

A number of trees (typically five) are arranged on each of four manifolds, which commingles the flow from each tree and directs the flow to an adjacent production riser base. A number of such tree and manifolds may be used, typically providing a total of twenty subsea trees.

Each manifold is connected to an adjacent offset production riser via spools that provide production, annulus access and control functions. The offset riser consists of near vertical steel pipes connected by threaded couplings. The risers are vertically supported by near surface aircans which maintain tension in the riser sufficient to withstand environmental and operational loads. At the top of the riser a flexible pipe jumper is used to connect between the riser and the production vessel. The production riser may be single string for service ie. water injection or concentric dual string for production where the outer annulus may be used for insulation of gas injection/lift.

It will be apparent to a person skilled in this technology that this arrangement greatly reduces the number of production risers required for such a development from approximately twenty to five, since the wells are manifolded subsea. This reduces riser steel weight, tensioning requirements and wellbay size. Furthermore the arrangement facilitates subsea wellbore isolation at the subsea wellhead improving safety, reliability of such a system and simplifies the wellbay and moonpool layout. Most importantly these benefits are provided without the loss of vertical wellbore access for drilling and workover and with the ability to use a high pressure drilling riser and surface BOP.

The invention will now be described in more detail by way of example only with reference to the accompanying drawings in which:

FIG. 1 is a general view showing the method of the invention in use;

FIG. 1*a* is a view similar to that of FIG. 1 but showing an alternative arrangement;

Figure 1:
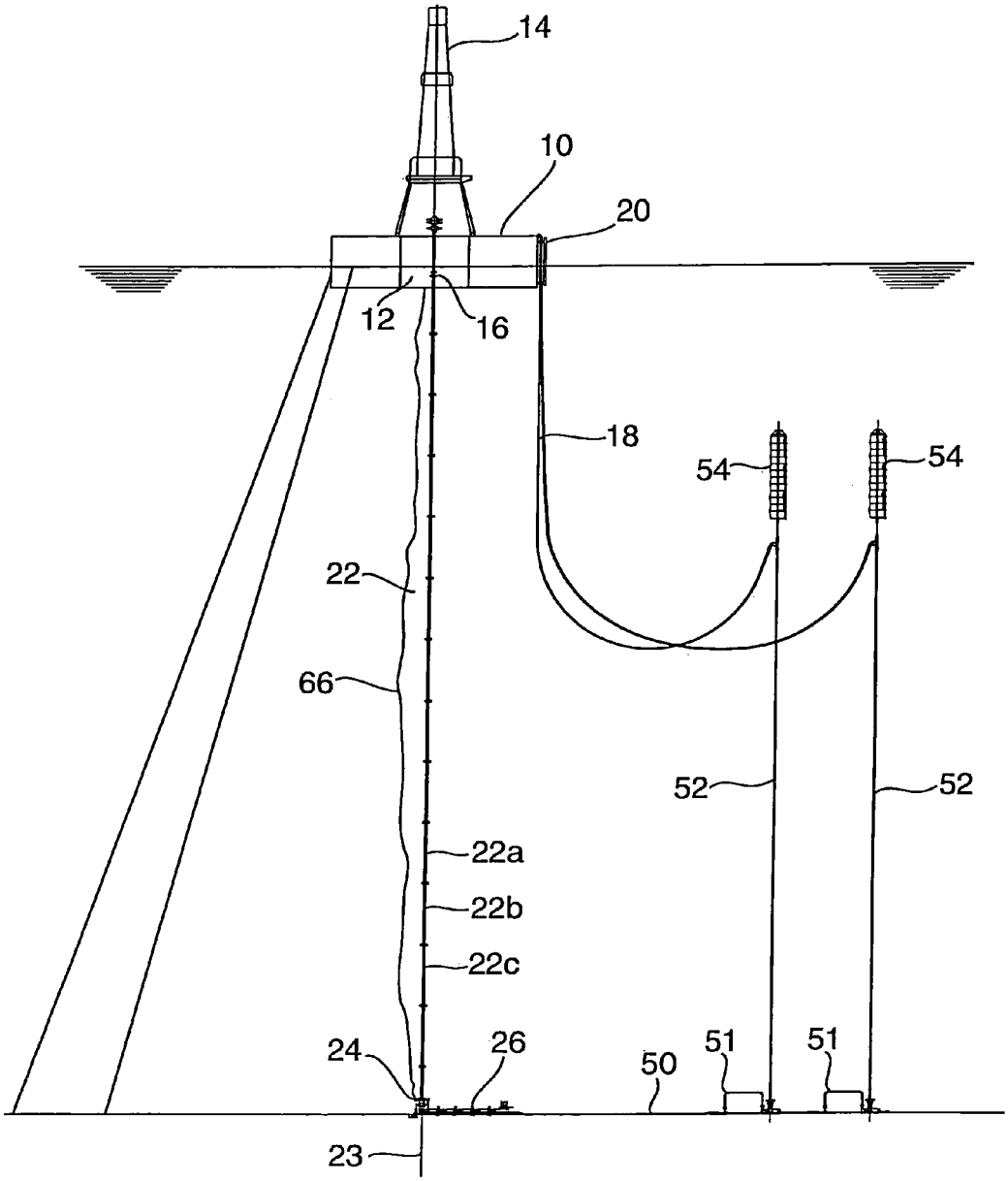

Drilling takes place from a vessel 10 which consists of a steel or concrete barge with a central moonpool 12. The vessel is permanently spread moored for the duration of the field life or alternatively may be turret moored. Typical dimension of the barge are 175 m long, 60 m width and a depth of 15 m. It will however be clear to the skilled man that these dimensions may be varied according to the requirements of each particular development. The main function of the barge is to provide drilling and workover for subsea wells that are located directly below the vessel. However, the barge may also provide other functions such as personnel accommodation, process and storage.

Drilling and workover of a well 23 takes place through a high pressure riser 22. Production, ie the bringing of oil or gas form the well 23 to the surface, takes place through an offset production riser 52.

Drilling and workover is conducted through the central moonpool 12 which is typically 10 m×15 m plan area, allowing installation of manifolds, trees, drilling riser and offset production risers. The drilling facilities consist of a conventional derrick 14 and mud and pipe handling facilities. The drilling facilities are modular and can be skidded onto the barge 10 during barge construction and possibly removed at the end of the drilling phase. The arrangement uses a surface BOP 16, which is located within the moonpool immediately below the drill floor. Sufficient vertical space is provided to accommodate stroking of the BOP in the worst anticipated storm condition without impact with the hull structure.

Flexible jumpers 18 from the offset production risers 50,52 are connected to the barge via porches 20 located on the side of the barge. The porches are located away from the drilling area to provide good separation between drilling and production facilities for safety reasons.

The drilling riser 22 extends below the barge 10 to the wells on the seabed and is rated to resist the maximum shutin pressure of the reservoir. Isolation is achieved by the use of a surface BOP. The riser may be either single string or dual string, depending on particular reservoir parameters. A single string riser could have a diameter of approximately 24 inches and a dual string (concentric) riser could have pipe dimensions typically 22 inches diameter for the outer pipe and 13⅜ inch diameter for the internal liner.

The drilling riser 22 is run through the moonpool of the production vessel and is assembled from a series of riser joints (22*a*, 22*b*, 22*c*, . . . ) using mechanical connections. At the bottom end the riser pipe is attached to the upper mandrel of a production tree 24 via a hydraulic collet connector. The tree will be described in more detail with reference to FIG. 2.

A tapered stress joint is used between the tree connector and the first standard riser joint to accommodate local stresses resulting from environmental loading and vessel offset. The tapered stress joint is a pipe section with an increasing wall thickness along its length to resist bending loads. The taper joint may be manufactured from steel or titanium if lower wellhead loads are required. The bore of the taper joint incorporates an orientation pin or similar device to allow orientation of the tubing hanger and tubing hanger running tool. The pin is hydraulically extended into the bore of the taper joint and impinges on a helical profile provided on the tubing hanger running tool.

In use, the riser 22 is lowered through the moonpool 12 and connected to the subsea tree 24 at the top of a well 23. The tree 24 is preinstalled on a subsea manifold 26. After connection to the subsea tree the drilling riser is tensioned within the moonpool of the barge using a hydro-pneumatic system. The uppermost joint of the riser string is machined with a profile to accept the BOP 16 and a conventional diverter (not shown) is located below the drill floor.

In an alternative embodiment, the subsea tree can be installed on the bottom of the drilling riser and can be lowered to the seabed with the riser.

Where a dual string riser 22 is being used, after drilling the top hole section, an internal smaller diameter casing is run inside the outer pipe to provide a high pressure liner through which the remaining bottom hole section is drilled. The liner is assembled from threaded casing and is latched into a profile inside the bore of the subsea wellhead 24. This requires the liner to be installed through the taper joint and bore of the subsea tree 36. Once the liner is latched and sealed to the bore of the wellhead it is pretensioned at the surface against the outer 22 inch pipe using a bowl and slip assembly. A high pressure surface BOP is attached to the upper end of the liner for drilling the higher pressure bottom hole section. Alternatively the internal liner can be latched and sealed in the bore of the subsea tree.

Following drilling to total depth the well is completed by installation of production tubing and tubing hangers. This is achieved in the case of the dual string drilling riser by removal of the inner liner to provide full bore access through the drilling riser to allow passage of the tubing hanger, which is landed in the body of the tree.

After drilling and completing on one well the drilling riser is disconnected from the tree, lifted slightly and then jumped across to the next well to be drilled or requiring intervention, without retrieval to the surface. The subsea tree 24 (FIG. 2) is a 'drill through' design.

Figure 2:
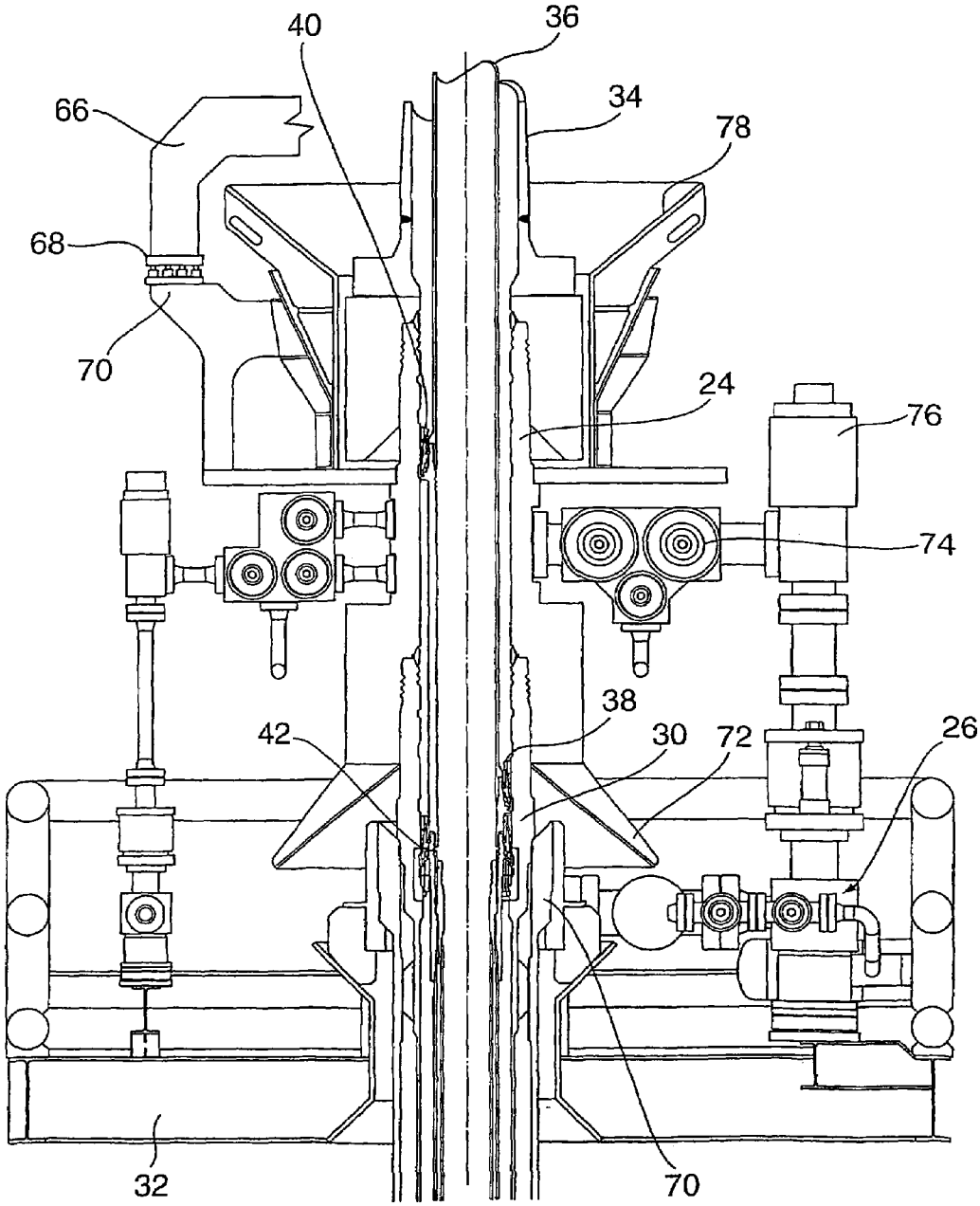
FIG. 2 is a cross-section through a subsea tree and manifold for use in the invention.

FIG. 2 shows the manifold 26, a wellhead 30 and a subsea tree 24 mounted on the wellhead. This Figure shows a dual string riser with an outer low pressure drilling riser 34 and an inner high pressure riser 36. The high pressure riser has to be sealed to the wellhead, and FIG. 2 shows two possible ways in which this sealing can be completed. On the right hand side of the centre axis, the riser 36 is shown sealed by seals 38 directly in a bore in the well head 30. On the left hand side of the centreline, the riser is shown sealed indirectly to the wellhead by seals 40 in the tree 24. The tree is then itself sealed to the wellhead 30 by further seals at 42.

The well casings are hung from hangers 70 in the wellhead 30. The tree 24 has a downwardly flared connector collar 72 which locates over the top of the tree. The tree has production valves 74 and a production choke 76. At the upper end of the tree, there is a re-entry funnel 78 to facilitate re-entry to the well.

On completion of the well the tubing hanger is landed in the bore of the tree spool with horizontal wing outlets. When the tubing hanger is not installed, full bore access is provided through the tree for access into the lower wellbore. This allows the high pressure liner 36 to be run through the tree and landed and locked inside the wellhead (see 38 in FIG. 2).

The tree 24 will have a machined profile on the bore of the spool. This will be used to latch and seal the internal tieback sleeve (if a dual concentric design is used).

Figure 3:
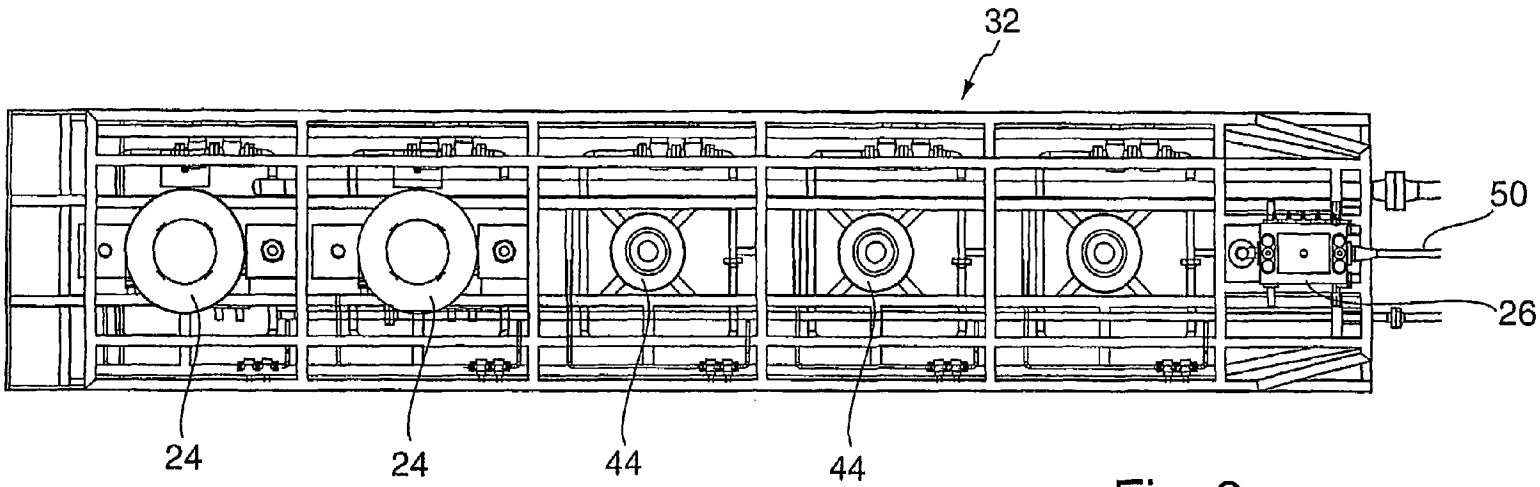
FIG. 3 is a plan view of a manifold.
Figure 4:
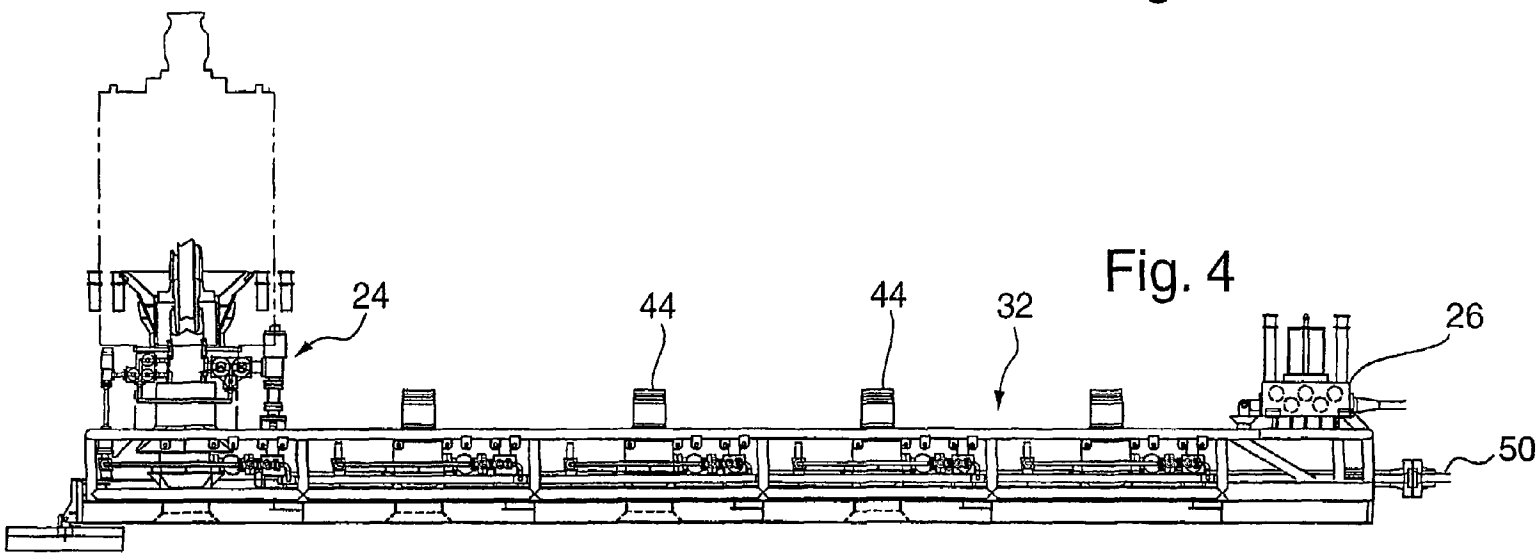
FIG. 4 is a side view of the manifold of FIG. 3.

A template 32 (see FIG. 3) is used to determine the positions of the wells. The template is designed so that it can be installed through the moonpool 12 of the barge 10. Each template has locations 44 through which wells will be drilled. In the example shown there are locations for up to five wells. The locations are arranged in a row such that the template is long and thin and can pass through the moonpool vertically. The template incorporates temporary mudmats for stability prior to drilling and incorporates piping and valving for serving each well drilled through the template, and a manifold 26 to which the piping is connected so that the manifold can commingle production flow and, distribute control functions to individual trees located in the locations 44.

An alternative arrangement is to locate the wells off the template and connect them to the template using jumpers. This allows the size of the template structure to be reduced.

An umbilical 66 (FIG. 1) can be used to control some of the tree functions. The umbilical will be run down the outside diameter of the drilling riser and will terminate at a stab plate 68 adjacent to the base riser connector. The stab plate 68 mates with a similar stab plate 70 on the tree.

The templates are lowered through the moonpool vertically on drill pipe and rotated to the horizontal after passing the keel or on the seabed. The manifold can be installed complete with jumper spools 50 that, in use, connect the manifold to the base of the offset production riser 52. These jumper spools may be 200–300 m long. The spools are assembled in the moonpool using threaded connections and are neutrally buoyant in water due to being air filled and coated with a thick and lightweight thermal insulation material.

The manifolds are lowered and positioned on the seabed so that the end of the jumper spools connects with or lands close to preinstalled foundation piles 51 onto which the offset risers are attached. Multiple manifold units can be used, depending on the total number of wells required. The manifolds are positioned on the seabed to allow good access from the barge, to protect the wellheads from dropped objects and to allow the required distribution of offset risers 52 around the perimeter of the barge.

The offset risers 52 consist of a pipe in pipe configuration. The central pipe diameter is sized for the main flow path and the annulus between the central and outer pipe is filled with air and a vapour phase corrosion inhibitor which, together with the buoyancy material around the outer pipe, provides thermal insulation to the production pipe. Alternatively the annulus can be used for gas lift or gas injection and will then be filled with pressurised hydrocarbon gas. Preheating the gas prior to injection into the riser provides an effective means of heating the central pipe to maintain product arrival temperatures.

The outside surface of the outer pipe 52 is coated with a corrosion protection material such as fusion-bonded epoxy or thermally sprayed aluminium. Buoyancy material is attached to the large diameter pipe, which is sized such that the pipe section is near neutrally buoyant in water in the production mode.

The production riser 52 is offset from the production vessel, and is tensioned using aircans 54 connected to the top of the riser 52. The aircans are attached to the riser by an articulation 56 that allows the aircan to rotate independently to the riser.

Figure 1A:
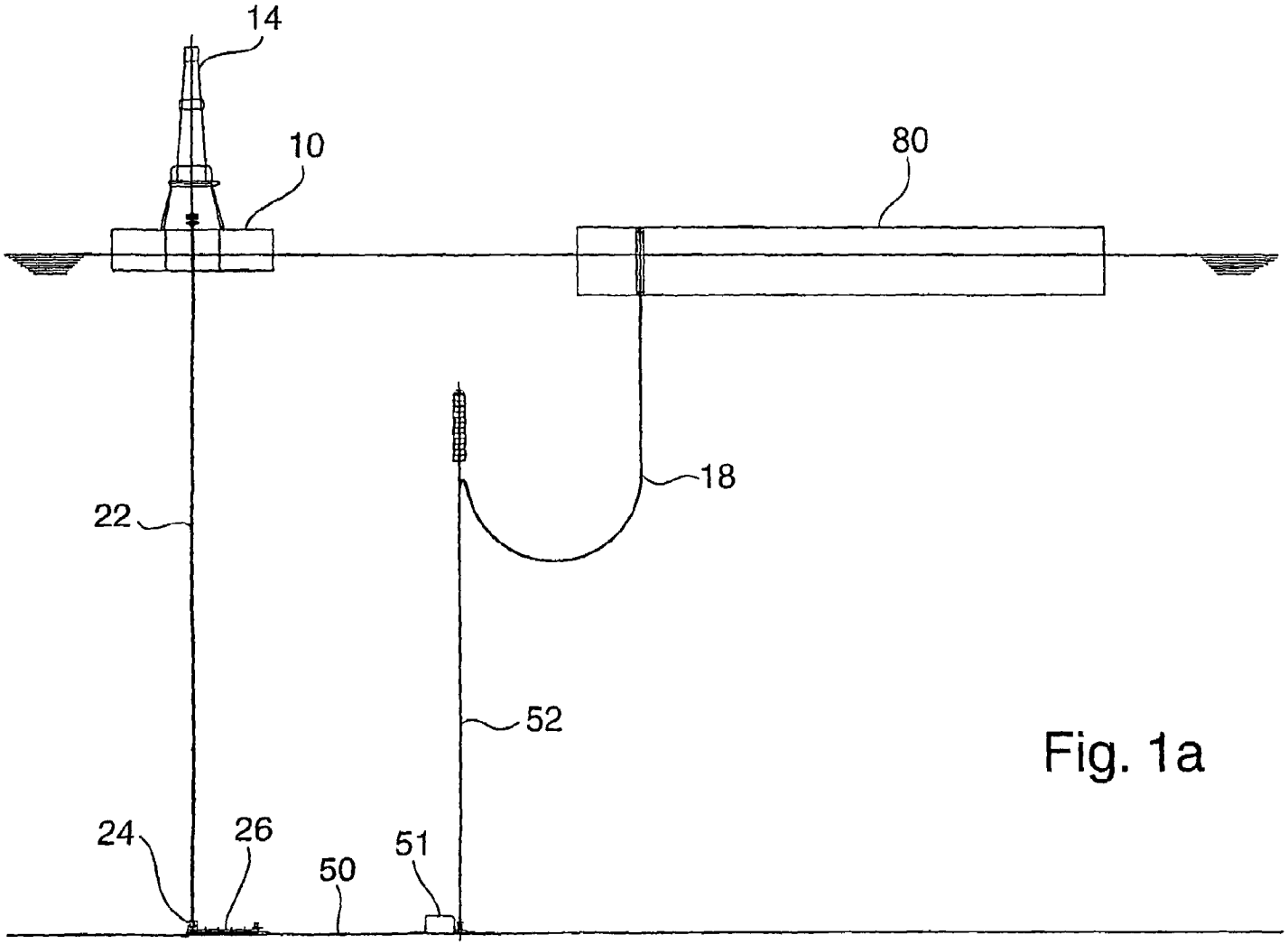
Figure 5:
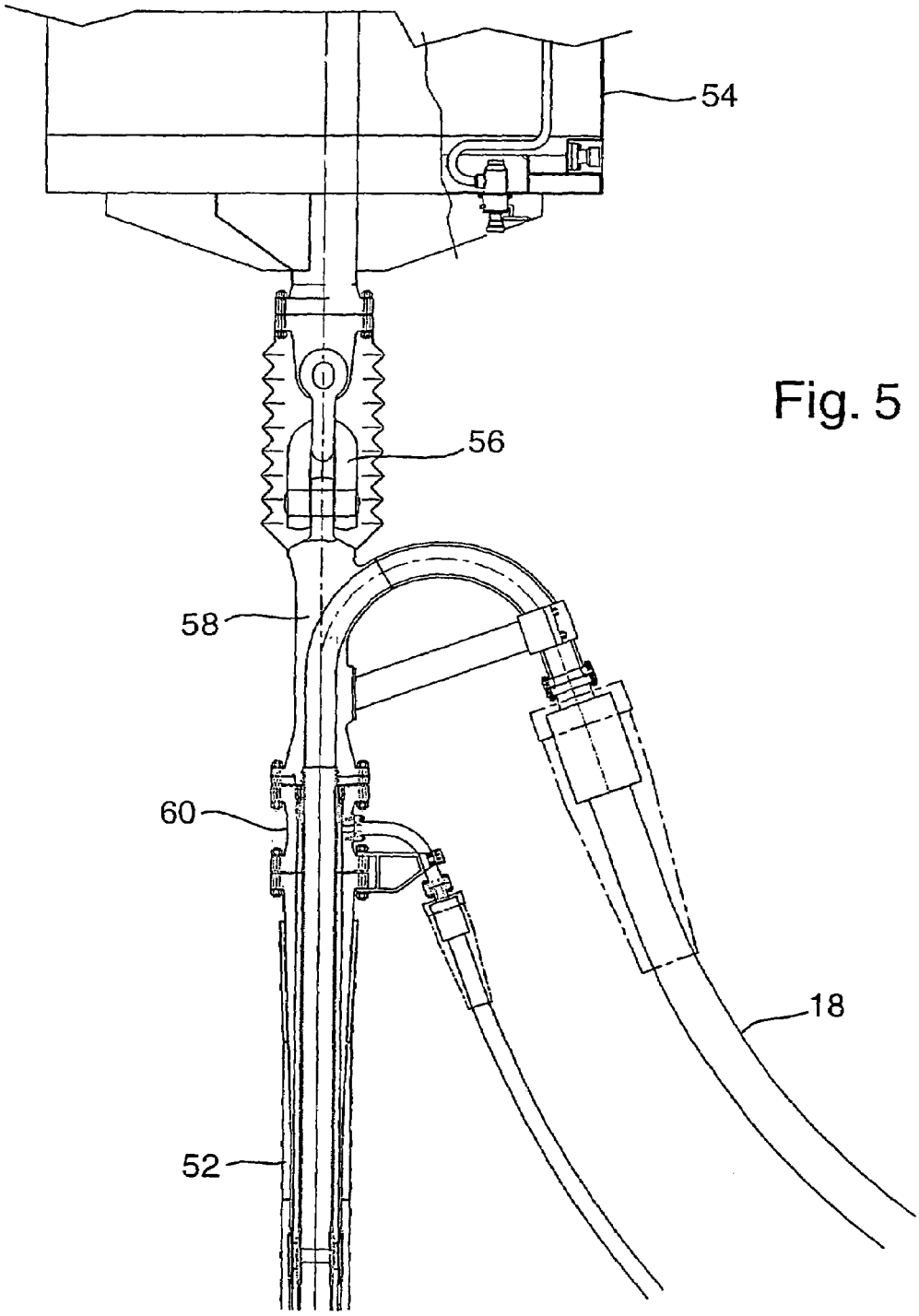
FIG. 5 shows a detail of the offset riser upper assembly.

Beneath the articulation a gooseneck assembly 58 (FIG. 5) is located to provide a fluid outlet flow path to jumpers 18. The jumpers connect the riser 52 to the vessel 10 and are assembled from flexible pipe manufactured from steel reinforced thermoplastic materials. The jumpers are configured in free hanging catenaries and connect to porches 20 located on the perimeter of the barge. Alternatively the jumpers can be connected directly to an adjacent storage facility 80 and not to the drilling barge. This is shown in FIG. 1*a*. A third option is to connect the jumpers to the drilling barge 10 for early production and at a later date transfer the jumpers over to the adjacent storage facility 80 for the remaining life of field.

Below the gooseneck is a spool 60 machined with an internal profile used to suspend and pre-tension the internal pipes of the riser 52 inside the outer carrier.

The spool interfaces with the gooseneck assembly providing flow paths and communication with the gooseneck. The design of the spool is similar to that used for wellhead tubing hangers wherein a hanger, complete with seals and lock down mechanisms is located within an outer wellhead or bowl.

Figure 6:
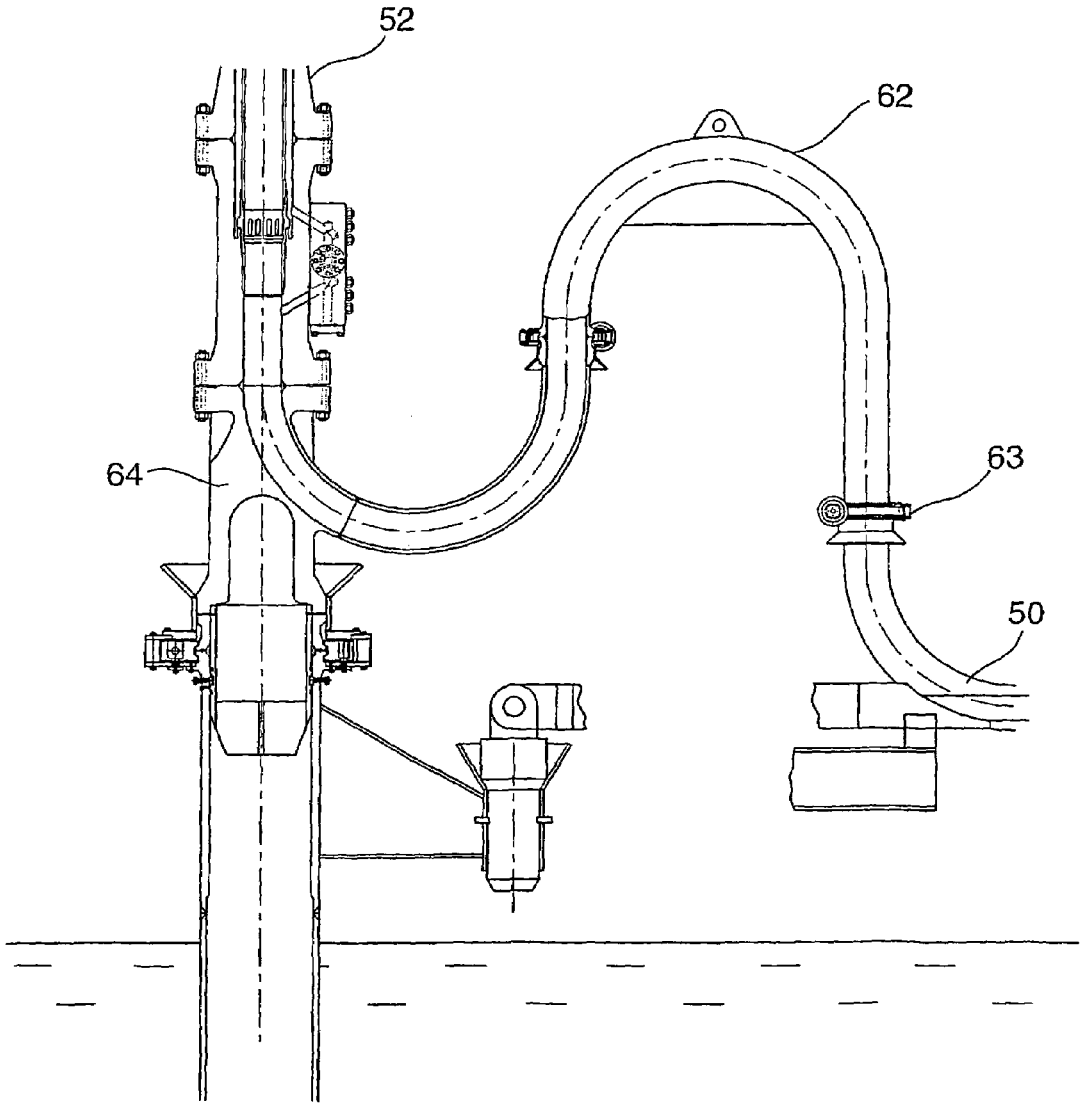
FIG. 6 shows a detail of the offset riser base arrangement

At the base of the production riser 52 (FIG. 6), the riser is connected to a mandrel profile fabricated onto the upper end of a pile that may be drilled and grouted or jetted. A flowbend 62 with outboard hub 63 is incorporated at the bottom of the riser string. The hub 63 allows connection of the jumper spool 50 (which itself connects to the subsea trees 24) via a vertically installed spool 64.

The system described here allows subsea wells to be drilled and then brought into production in an efficient and simple manner.

It is an advantage of the invention that the production risers can be run through the moonpool of the moored drilling vessel and a smaller vessel can be used to do the final installation onto the riser foundation.

The invention claimed is:

1. A method of preparing and operating a subsea well, the method comprising the steps of:

locating a plurality of drill-through subsea trees on a respective plurality of subsea wellheads, each of the plurality of drill-through subsea trees being connected by a manifold;

sealingly connecting a high pressure drilling riser between one of the plurality of trees and a drilling platform at the sea surface;

mounting a blow out preventer at the top of the riser;

drilling the well through the drilling riser and the subsea tree; and establishing a production connection between the tree and the manifold through a production riser which is separated from the drilling riser;

wherein the high pressure drilling riser comprises two concentric riser pipes, the inner of the pipes being a high pressure riser and the outer of the pipes being a low pressure riser; and wherein the low pressure riser is first connected between the tree and the drilling platform with a low pressure blow out preventer mounted at the top of the riser, the well is drilled to a first depth, the low pressure blow out preventer is removed, the high pressure riser is run into the low pressure riser, a high pressure blow out preventer is mounted at the top of the high pressure riser, and the well is drilled to a second, greater depth.

2. A method of preparing and operating a subsea well, the method comprising the steps of:

locating a plurality of drill-through subsea trees on a respective plurality of subsea wellheads, each of the plurality of drill-through subsea trees being connected by a manifold;

sealingly connecting a high pressure drilling riser between one of the plurality of trees and a drilling platform at the sea surface;

mounting a blow out preventer at the top of the riser;

drilling the well through the drilling riser and the subsea tree; and establishing a production connection between the tree and the manifold through a production riser which is separated from the drilling riser;

wherein the drilling platform and a production collection facility are provided on separate platforms at the sea surface.

3. A method as claimed in claim 2, wherein the one or more production risers are initially connected to the drilling platform for early production and are subsequently disconnected and reconnected to the production collection platform.

4. A method of preparing and operating a subsea well, the method comprising the steps of:

locating a plurality of drill-through subsea trees on a respective plurality of subsea wellheads, each of the plurality of drill-through subsea trees being connected by a manifold;

sealingly connecting a high pressure drilling riser between one of the plurality of trees and a drilling platform at the sea surface;

mounting a blow out preventer at the top of the riser;

drilling the well through the drilling riser and the subsea tree;

establishing a production connection between the tree and the manifold through a production riser which is separated from the drilling riser; and providing one or more manifolds to connect the plurality of drill-through subsea trees; and wherein a single production riser is associated with each manifold;

wherein the or each manifolds are installed through a moonpool of a moored, floating vessel and are initially run in a vertical orientation in order to pass the moonpool and are subsequently rotated horizontally after landing on the seabed or in midwater.

5. A floating drilling and production system for deep water comprising a floating vessel, a plurality of drill-through subsea trees located below the floating vessel, the plurality of trees being connected to a subsea manifold, a high pressure drilling workover riser extending between one of the plurality of trees and the vessel, a blow-out preventer located on the vessel at the top of the riser, and a production riser extending from the manifold to near the water surface, the production riser being separated from the drilling riser; wherein the drilling riser comprises means by which it can be selectively coupled to one of the trees and can be moved from one tree to another.

6. A floating drilling and production system for deep water comprising a floating vessel, a plurality of drill-through subsea trees located below the floating vessel, the plurality of trees being connected to a subsea manifold, a high pressure drilling workover riser extending between one of the plurality of trees and the vessel, a blow-out preventer located on the vessel at the top of the riser, and a production riser extending from the manifold to near the water surface, the production riser being separated from the drilling riser; wherein there are a plurality of manifolds, and each manifold has a production riser.

7. A floating drilling and production system for deep water comprising a floating vessel, a plurality of drill-through subsea trees located below the floating vessel, the plurality of trees being connected to a subsea manifold, a high pressure drilling workover riser extending between one of the plurality of trees and the vessel, a blow-out preventer located on the vessel at the top of the riser, and a production riser extending from the manifold to near the water surface, the production riser being separated from the drilling riser; wherein the drilling riser comprises a dual string concentric pipe arrangement with an outer riser extending from the floating vessel connected and sealed to a drill through subsea tree connected onto a subsea well, for drilling an initial low pressure interval, and a retrievable inner riser extending from the surface to the subsea tree inside the outer riser and connected and sealed on the bore of the subsea tree or wellhead.

8. A floating drilling and production system as claimed in claim 7, wherein the inner string is a casing.

9. A floating drilling and production system for deep water comprising a floating vessel, a plurality of drill-through subsea trees located below the floating vessel, the plurality of trees being connected to a subsea manifold, a high pressure drilling workover riser extending between one of the plurality of trees and the vessel, a blow-out preventer located on the vessel at the top of the riser, and a production riser extending from the manifold to near the water surface, the production riser being separated from the drilling riser; wherein a control umbilical is run on the outside diameter of the drilling riser to provide control of the subsea tree.

10. A floating drilling and production system for deep water comprising a floating vessel, a plurality of drill-through subsea trees located below the floating vessel, the plurality of trees being connected to a subsea manifold, a high pressure drilling workover riser extending between one of the plurality of trees and the vessel, a blow-out preventer located on the vessel at the top of the riser, and a production riser extending from the manifold to near the water surface, the production riser being separated from the drilling riser; wherein the manifold is connected to an adjacent offset production riser via spools that provide production, annulus access and control functions.

11. A floating drilling and production system as claimed in claim 10, wherein the or each offset riser consists of near vertical steel pipes connected by threaded couplings.

12. A floating drilling and production system for deep water comprising a floating vessel, a plurality of drill-through subsea trees located below the floating vessel, the plurality of trees being connected to a subsea manifold, a high pressure drilling workover riser extending between one of the plurality of trees and the vessel, a blow-out preventer located on the vessel at the top of the riser, and a production riser extending from the manifold to near the water surface, the production riser being separated from the drilling riser; wherein the system further comprises a production vessel, the production riser being connected to the production vessel.

13. A floating drilling and production system for deep water comprising a floating vessel, a plurality of drill-through subsea trees located below the floating vessel, the plurality of trees being connected to a subsea manifold, a high pressure drilling workover riser extending between one of the plurality of trees and the vessel, a blow-out preventer located on the vessel at the top of the riser, and a production riser extending from the manifold to near the water surface, the production riser being separated from the drilling riser; wherein the production riser is vertically supported by near surface aircans which maintain tension in the riser sufficient to withstand environmental and operational loads.

14. A floating drilling and production system as claimed in claim 13, wherein a flexible pipe jumper is used at the top of the production riser to connect between the riser and the production vessel.

15. A floating drilling and production system for deep water comprising a floating vessel, a plurality of drill-through subsea trees located below the floating vessel, the plurality of trees being connected to a subsea manifold, a high pressure drilling workover riser extending between one of the plurality of trees and the vessel, a blow-out preventer located on the vessel at the top of the riser, and a production riser extending from the manifold to near the water surface, the production riser being separated from the drilling riser; wherein the or each production riser is concentric dual string for production and the outer annulus may be used for insulation of gas injection/lift.

16. A floating drilling and production system for deep water comprising a floating vessel, a plurality of drill-through subsea trees located below the floating vessel, the plurality of trees being connected to a subsea manifold, a high pressure drilling workover riser extending between one of the plurality of trees and the vessel, a blow-out preventer located on the vessel at the top of the riser, and a production riser extending from the manifold to near the water surface, the production riser being separated from the drilling riser; wherein the or each manifold has near neutrally buoyant rigid flowline spools.

17. A floating drilling and production system for deep water comprising a floating vessel, a plurality of drill-through subsea trees located below the floating vessel, the plurality of trees being connected to a subsea manifold, a high pressure drilling workover riser extending between one of the plurality of trees and the vessel, a blow-out preventer located on the vessel at the top of the riser, and a production riser extending from the manifold to near the water surface, the production riser being separated from the drilling riser; wherein a radial orientation key is provided in the bore of the high pressure drilling riser to locate and align a tubing hanger landed in the bore of a drill-through spool tree.

18. A floating drilling and production system for deep water comprising a floating vessel, a plurality of drill-through subsea trees located below the floating vessel, the plurality of trees being connected to a subsea manifold, a high pressure drilling workover riser extending between one of the plurality of trees and the vessel, a blow-out preventer located on the vessel at the top of the riser, and a production riser extending from the manifold to near the water surface, the production riser being separated from the drilling riser wherein the drilling riser is a single string drilling riser, and a shear ram module is provided at the base of the riser to isolate the well in the event of a riser failure and wherein the shear ram module connects to the subsea tree mandrel via a remote connector and has at its top end a mandrel onto which the drilling riser is connected.

* * * * *